US007936886B2

(12) United States Patent
Kim

(10) Patent No.: US 7,936,886 B2
(45) Date of Patent: May 3, 2011

(54) SPEAKER SYSTEM TO CONTROL DIRECTIVITY OF A SPEAKER UNIT USING A PLURALITY OF MICROPHONES AND A METHOD THEREOF

(75) Inventor: Jong-bae Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1389 days.

(21) Appl. No.: 10/995,367

(22) Filed: Nov. 24, 2004

(65) Prior Publication Data

US 2005/0141735 A1 Jun. 30, 2005

(30) Foreign Application Priority Data

Dec. 24, 2003 (KR) ..... 10-2003-0096197

(51) Int. Cl.

| | |
|---|---|
| ***H04R 29/00*** | (2006.01) |
| ***H04R 5/00*** | (2006.01) |
| ***H04R 1/40*** | (2006.01) |
| ***H04R 3/00*** | (2006.01) |
| ***H04R 25/00*** | (2006.01) |
| ***H04R 1/02*** | (2006.01) |
| ***H03G 3/20*** | (2006.01) |

(52) U.S. Cl. ..... 381/59; 381/56; 381/57; 381/58; 381/1; 381/17; 381/18; 381/97; 381/111; 381/313; 381/387

(58) Field of Classification Search ..... 381/56–59, 381/1, 17, 89, 97, 111, 313, 387, 303
See application file for complete search history.

(56) References Cited

U.S. PATENT DOCUMENTS

| | | | | |
|---|---|---|---|---|
| 5,233,664 | A * | 8/1993 | Yanagawa et al. | 381/89 |
| 5,568,557 | A * | 10/1996 | Ross et al. | 381/71.11 |
| 6,128,395 | A * | 10/2000 | De Vries | 381/387 |
| 6,449,368 | B1 | 9/2002 | Davis et al. | |
| 2002/0097885 | A1 | 7/2002 | Birchfield et al. | |

FOREIGN PATENT DOCUMENTS

| | | |
|---|---|---|
| JP | 04-337999 | 11/1992 |
| JP | 06-062488 | 3/1994 |
| JP | 06-205496 | 7/1994 |
| JP | 07-059200 | 3/1995 |
| JP | 07-212896 | 8/1995 |
| JP | 11-225400 | 8/1999 |
| JP | 2003-032776 | 1/2003 |
| JP | 2003-270034 | 9/2003 |
| WO | 03/071827 | 8/2003 |

OTHER PUBLICATIONS

Japanese Office Action issued Jul. 6, 2010 in JP Application No. 2004-365084.

* cited by examiner

*Primary Examiner* — Devona E Faulk
(74) *Attorney, Agent, or Firm* — Stanzione & Kim, LLP

(57) ABSTRACT

A speaker system to control directivity of a speaker unit using a plurality of microphones, and a method thereof. The method includes sensing through a plurality of channels a shock sound with an impulse pattern generated at a listening position and measuring delay values between signals of the channels, reading a predetermined listening position compensation filter coefficient in accordance with the measured delay values, and controlling directivity of the speaker unit by granting the read compensation filter coefficient on input audio signals.

13 Claims, 6 Drawing Sheets

SPEAKER SYSTEM TO CONTROL DIRECTIVITY OF A SPEAKER UNIT USING A PLURALITY OF MICROPHONES AND A METHOD THEREOF

CROSS-REFERENCE TO RELATED APPLICATIONS

This application claims the priority of Korean Patent Application No. 2003-96197, filed on Dec. 24, 2003, in the Korean Intellectual Property Office, the disclosure of which is incorporated herein in its entirety and by reference.

BACKGROUND OF THE INVENTION

1. Field of the Invention

The present general inventive concept relates to a sound reproducing system, and more particularly, to a speaker system to control directivity of a speaker unit using a plurality of microphones and a method thereof.

2. Description of the Related Art

Commonly, one of the characteristics which determines quality of a loudspeaker is directivity. The directivity defines variations in frequency characteristics of sound pressure in different directions of the loud speaker. However, a wider directivity does not automatically ensure the quality of the speaker. It is rather advisable to determine a directivity pattern depending on the purpose of the speaker and the size of the area where the loudspeaker is expected to carry sound. For example, for an audio system, a wide directivity is required. For a public-address system, in order to prevent howling, a narrow directivity wherein the sound is propagated only in certain directions is required. There are other factors to be considered when determining the directivity of the loudspeaker. In a speaker system employing a single speaker unit, the directivity is determined depending on the construction of the unit, that is, whether the speaker unit is a cone speaker or a horn speaker. In a line source speaker system, where a plurality of speaker units are disposed in a linear array, each speaker unit is adapted to emit sound only in a direction determined in accordance with the physical construction and disposition of the speaker units. However, the need to change the directivity of the speaker according to a listening position often occurs.

A conventional directivity control speaker system is disclosed in U.S. Pat. No. 5,953,432 (U.S. application Ser. No. 08/911,183 filed on Aug. 14, 1997 to Yanagawa et al, Line Source Speaker System).

Referring to FIGS. 1A and 1B, a speaker system includes a digital filter array 22, an amplifier array 24 and a speaker unit array 26. The digital filter array 22 includes a plurality of digital audio signal processors (DASPs) $DF_1$-$DF_m$. Each DASP performs filtering of an audio signal input via a first input terminal IN1 and a second input terminal IN2 in accordance with a predetermined digital filter coefficient. The amplifier array 24, which includes a plurality of amplifiers $A_1$-$A_m$, amplifies the audio signals filtered by the digital filter array 22. The speaker unit array 26, which includes a plurality of speakers $SP_1$-$SP_m$ in a line source pattern, reproduces the audio signals amplified by the amplifier array 24. Therefore, the directivity of the audio signals is divided into directions S1 and S2 shown in FIG. 1B using the speaker system shown in FIG. 1A. Finally, audio signals input via the first input terminal IN1 and the second input terminal IN2 are reproduced in the directions S1 and S2, respectively.

However, in the conventional speaker system shown in FIG. 1A, directivity cannot be obtained in accordance with a listening position because an exact listening position measuring method for speaker driving is not provided, and since filters and amplifiers are included in each speaker unit, the conventional speaker system must include a special heat sink component.

Also, even if a speaker system with a multiple channel driver has an advantage in power handling, when a high frequency signal is reproduced, various lobes are generated, where each lobe represents a same sound pressure and depends on a wavelength of a reproducing frequency band and a distance between channel drivers. Accordingly, as shown in FIG. 2A, listening positions where frequency quality is flat and listening positions where the frequency quality is not flat exist. FIG. 2B is a graph illustrating frequency quality in a sweet spot and an off axis. The frequency quality in the sweet spot, which is an optimal position where a directive lobe exists, is flat over the entire frequency band, however, the frequency quality in the off axis has a problem that a sound pressure is not flat in certain bands.

SUMMARY OF THE INVENTION

The present general inventive concept provides a speaker system to control directivity of a speaker unit of two channels including a plurality of speaker arrays by measuring a listening position using a plurality of microphones and a method thereof.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a method of controlling directivity of a speaker system including a plurality of speaker arrays respectively corresponding to a plurality of channels, the method comprising sensing in each channel a shock sound having an impulse pattern generated at a listening position, and measuring delay values between signals of the channels, reading a predetermined listening position compensation filter coefficient in accordance with the measured delay values, and controlling directivity of the speaker unit by applying the read compensation filter coefficient to input audio signals.

The foregoing and/or other aspects and advantages of the present general inventive concept are also achieved by providing a speaker system including a plurality of speaker arrays comprising a listening position sensing unit sensing through a plurality of channels a shock sound with an impulse pattern generated at a listening position, a controller reading a predetermined listening position compensation filter coefficient in accordance with sound delay information between channels sensed by the listening position sensing unit and converting input audio signals into PWM audio signals by delay compensating the input audio signals using the compensation filter coefficient, and a power switching unit amplifying the PWM audio signals converted by the controller and outputting the amplified PWM audio signals via the plurality of speaker arrays.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
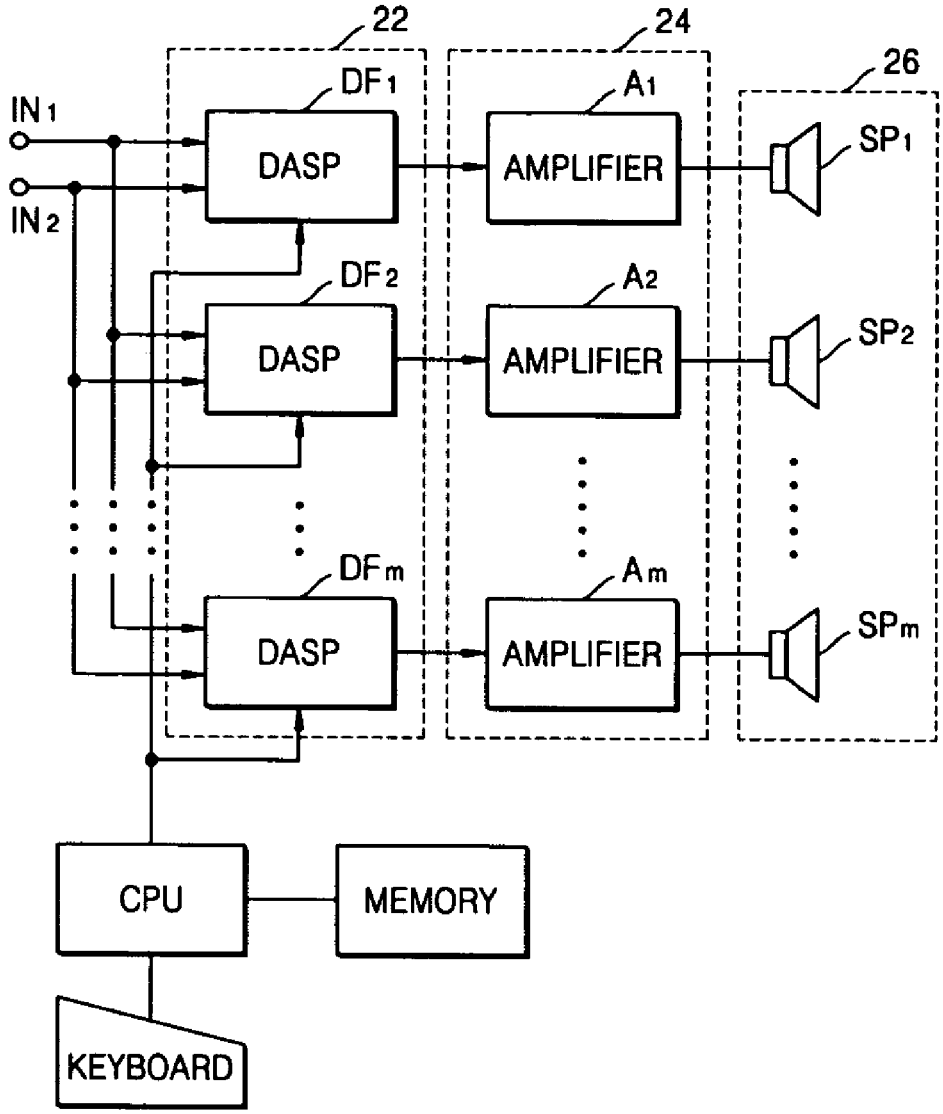
FIG. 1A (PRIOR ART)
FIGS. 1A and 1B illustrate a conventional speaker system.
Figure 1B:
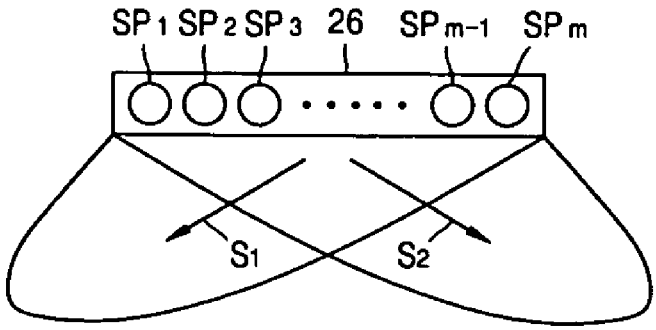
FIG. 1B (PRIOR ART)
Figure 2A:
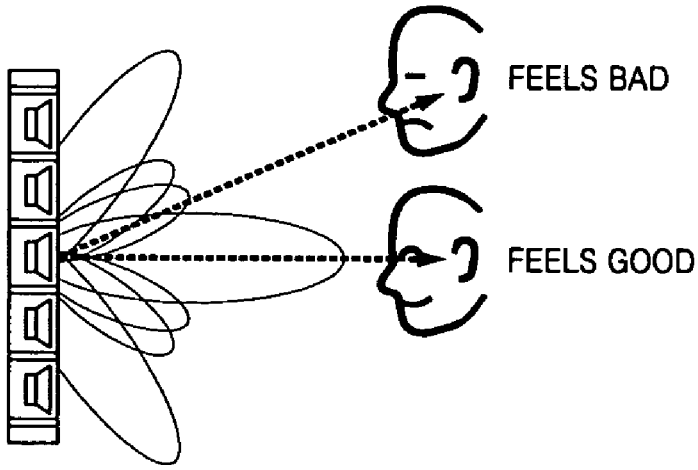
FIG. 2A (PRIOR ART)
FIG. 2A shows a position of a sweet spot in accordance with directivity.
Figure 2B:
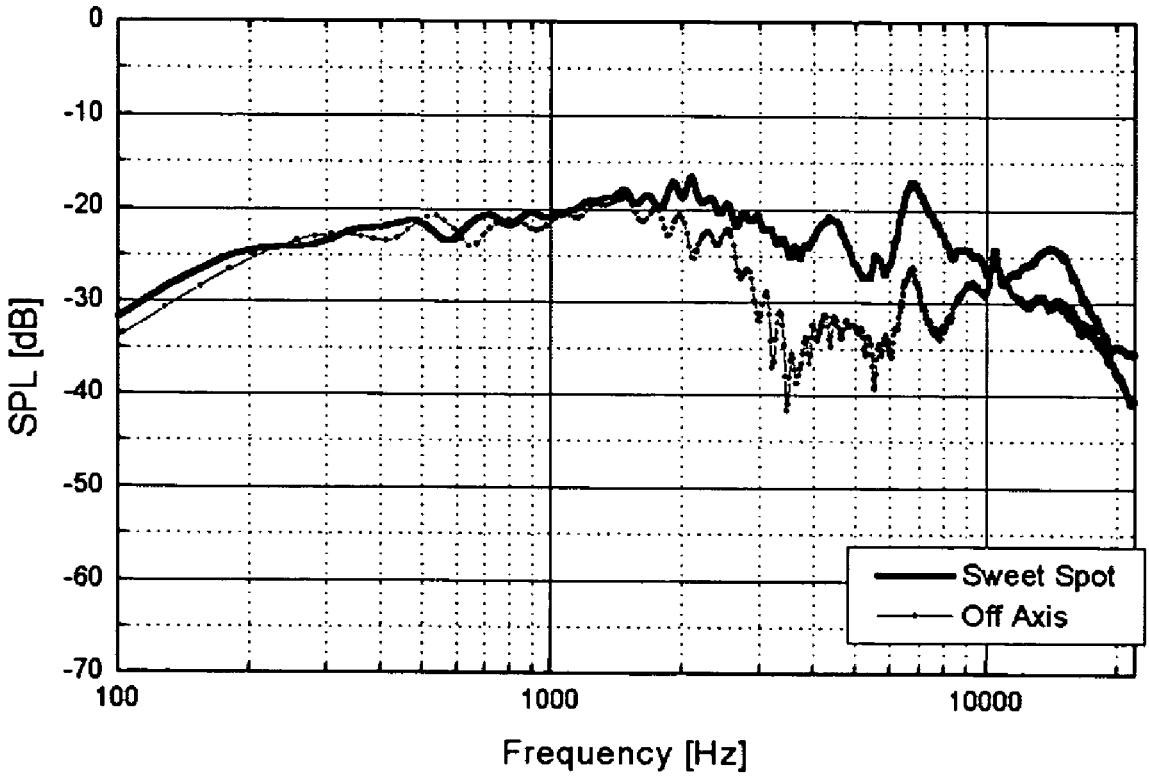
FIG. 2B (PRIOR ART)
FIG. 2B is a graph illustrating frequency quality in a sweet spot and an off axis.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
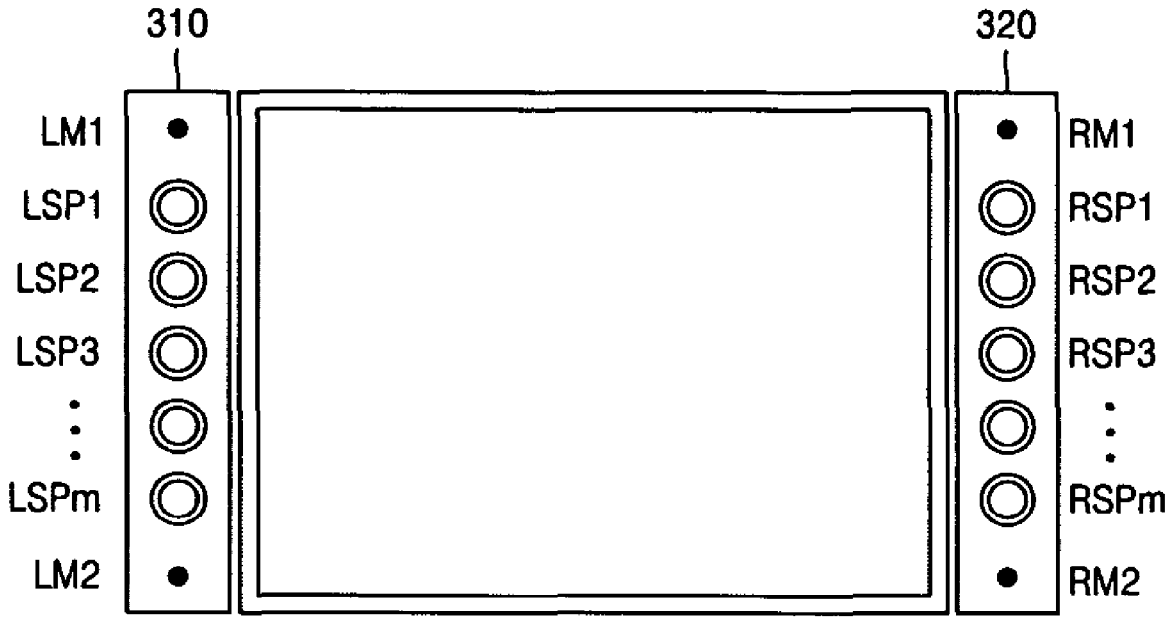
FIG. 3 is an outline diagram of a speaker system according to an embodiment of the present general inventive concept.

FIG. 3 is an outline diagram of a speaker system according to an embodiment of the present general inventive concept.

Referring to FIG. 3, the speaker system includes speaker array units 310 and 320 representing left and right channels. The speaker array units 310 and 320 of the left and right channels includes upper and lower microphones LM1-LM2 and RM1-RM2, respectively, and left and right speaker arrays LSP1-LSPm and RSP1-RSPm, respectively. The upper and lower microphones LM1-LM2 and RM1-RM2 of the left and right channels, respectively, sense a shock sound with an impulse pattern generated by a user at a listening position.

Figure 4:
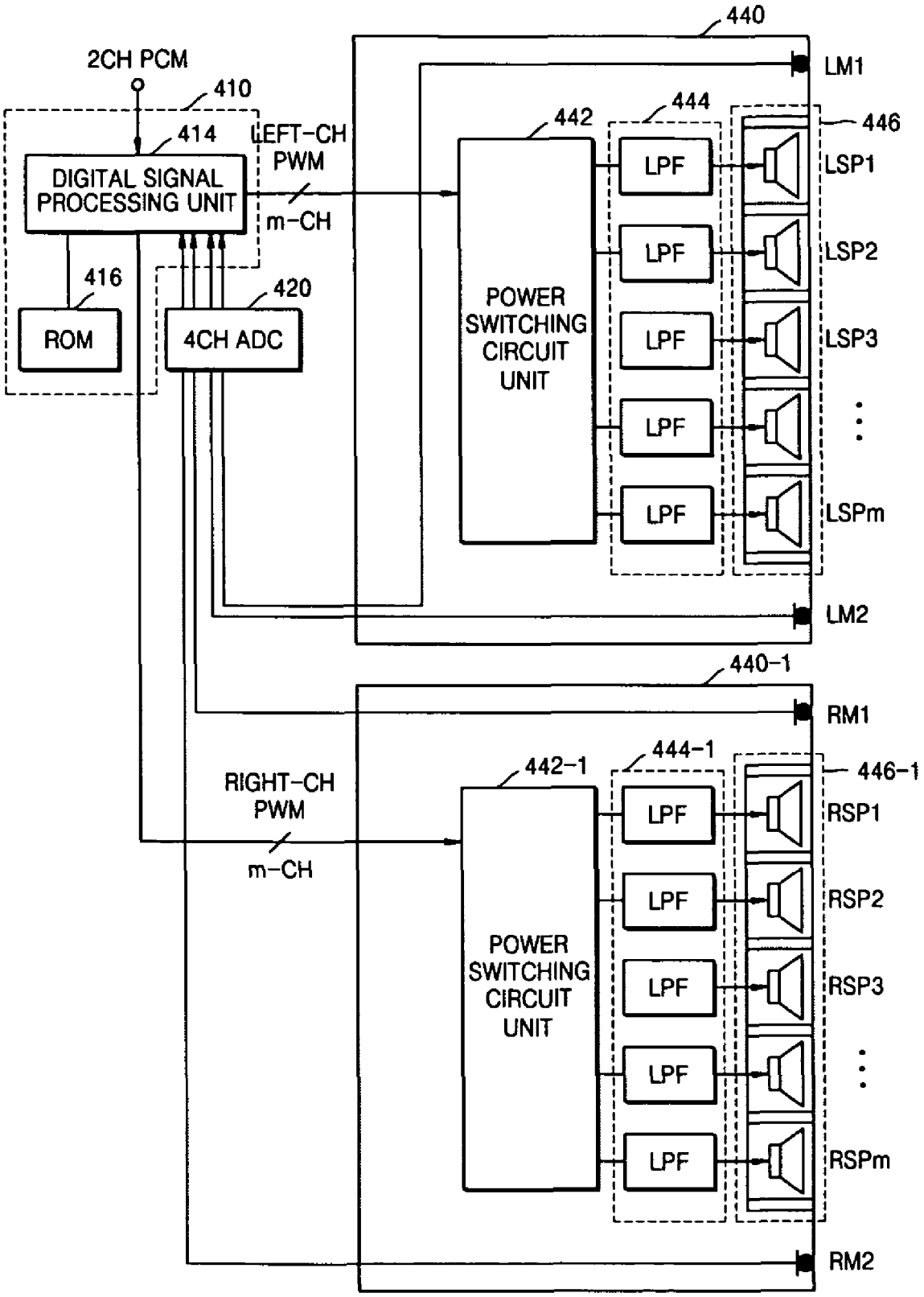
FIG. 4 is a block diagram of a speaker system according to an embodiment of the present general inventive concept.

FIG. 4 is a block diagram of a speaker system according to an embodiment of the present general inventive concept.

The speaker system of FIG. 4 includes a controller 410, left and right listening position sensing units LM1-LM2 and RM1-RM2, a 4-channel analog-to-digital converter (ADC) 420, and left and right channel signal reproducing units 440 and 440-1. The controller 410 includes a digital signal processing unit 414 and a ROM 416. The left and right listening position sensing units LM1-LM2 and RM1-RM2 use microphones. The left and right channel signal reproducing units 440 and 440-1, respectively, include power switching circuit units 442 and 442-1, low pass filter (LPF) arrays 444 and 444-1, and speaker arrays 446 and 446-1, respectively.

At the left and right listening position sensing units LM1-LM2 and RM1-RM2, for example, 2 microphones can be placed above and 2 microphones can be placed below the left and right speaker arrays 446 and 446-1, respectively, and can sense a shock sound generated as an impulse.

The 4-channel ADC 420 converts shock sounds with an analog pattern sensed as 4 channels by the left and right listening position sensing units LM1-LM2 and RM1-RM2 into digital signals, respectively.

The controller 410 calculates a signal delay value between the channels using the shock sounds converted to a digital pattern by the 4-channel ADC 420, reads a listening position compensation filter coefficient stored in the ROM 416 on the basis of the delay value, divides an input pulse code modulation (PCM) audio signal into m channels by convoluting it with m allocated compensation filter coefficients, and converts the delay-compensated m-channel audio signal using the compensation filter coefficients into a pulse width modulation (PWM) audio signal. Also, the controller 410 allows speaker units to have an optimal directivity effect at a current listening position by parallel processing an input 2-channel PCM audio signal into m channels using the listening position compensation filter coefficient.

The ROM 416 stores optimal listening position compensation filter coefficients corresponding to a plurality of delay values as a look-up table.

The power switching circuit units 442 and 442-1 each amplify low power m-channel PWM audio signals to high power PWM audio signals, respectively. Here, the low power PWM audio signals are converted into high power PWM audio signals by turning switching components such as a field effect transistor (FET) on/off.

The LPF arrays 444 and 444-1 convert the high power m-channel PWM audio signals input from the respective power switching circuit units 442 and 442-1 into signals with an audible audio band by low pass filtering.

The speaker arrays 446 and 446-1 each reproduce the m-channel audio signals input from the respective LPF arrays 444 and 444-1.

Figure 5:
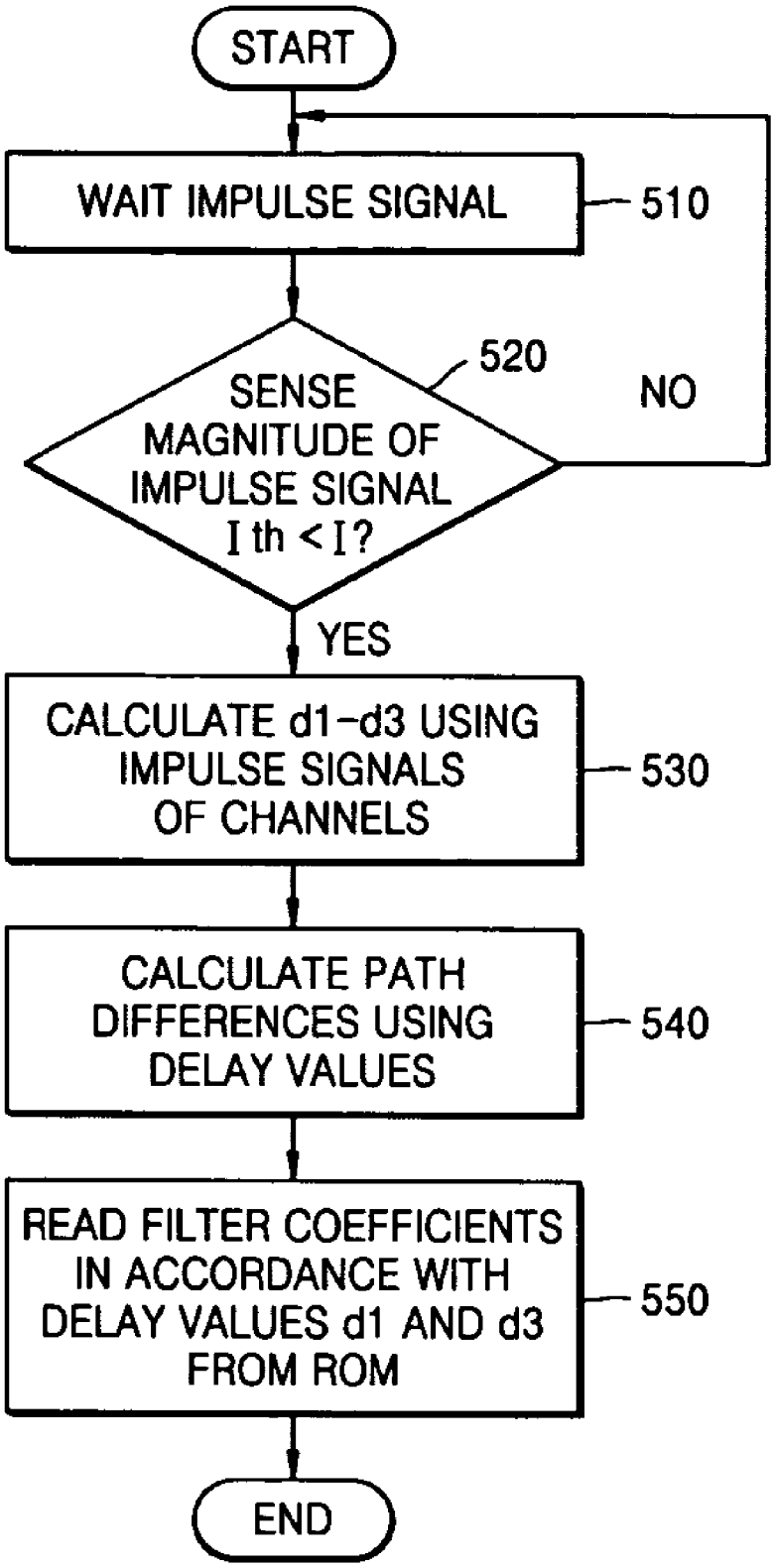
FIG. 5 is a flowchart of a method of measuring a signal delay in a controller of FIG. 4.

FIG. 5 is a flowchart illustrating a method of measuring a signal delay value in the controller 410 of FIG. 4.

When a speaker system is on, the controller 410 waits for an impulse signal to be generated at a listening position in operation 510.

Figure 6:
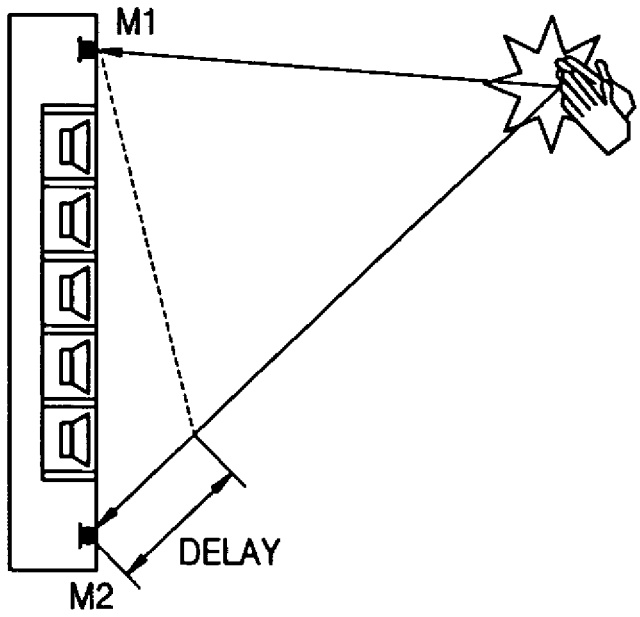
FIG. 6 shows a method of generating an impulse at a listening position, which is sensed by each microphone.

When the controller 410 senses impulse signals generated by a user with microphones in different channels as shown in FIG. 6, the controller 410 determines whether a magnitude I of a sound pressure of an impulse signal generated in each channel exceeds a threshold value $I_{th}$ in operation 520. Referring to FIG. 6, microphones located at the top and bottom of a speaker enclosure receive a clap sound of a listener, and subsequently, the microphones convert the clap sound into an impulse signal.

Whenever a magnitude I of sound pressure of an impulse signal generated in each channel exceeds the threshold value $I_{th}$, the controller 410 measures signal delay values d1-d3 between channels on a temporal domain in operation 530.

Figure 7:
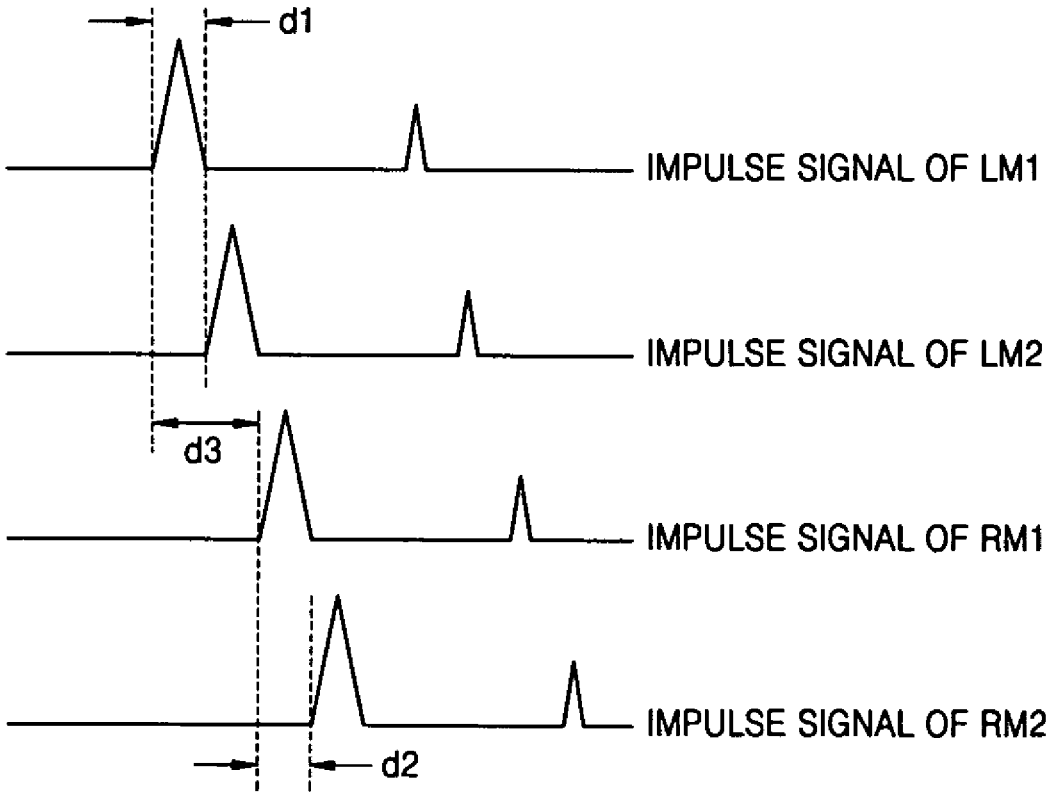
FIG. 7 illustrates a method of measuring a signal delay using impulses sensed by a plurality of microphones.

The controller 410 calculates path differences using the measured delay values d1-d3 on the temporal domain in operation 540. That is, referring to FIG. 7, a delay value d1 or d2 generated in accordance with a height difference between the upper and lower sides of a same channel and a delay value d3 generated in accordance with a width difference between left and right channels are obtained using a plurality of microphones LM1-LM2 and RM1-RM2 respectively installed in the speaker enclosures of the channels. Here, if an ideal speaker system is used, the delay values d1 and d2 are almost the same.

The controller 410 reads an optimal listening position compensation filter coefficient in accordance with the delay values d1 and d3 from a ROM 416 in operation 550. That is, the ROM 416 stores optimal listening position compensation filter coefficients corresponding to the delay values d1 and d3 in a matrix structure. The delay values d1 and d3 in the matrix structure and corresponding listening position compensation filter coefficients are realized using a look-up table. The controller 410 reads an optimal listening position compensation filter coefficient corresponding to the calculated delay values d1 and d3 from the look-up table. Eventually, the audio signals are convoluted with the optional listening position compensation filter coefficient. Accordingly, by compensating for the listening position using the listening position compensation filter coefficients corresponding to the delay values d1 and d3, speaker directivity is controlled so that the user can have an optimal directivity effect.

As described above, according to the present general inventive concept, directivity of a two channel speaker system can be controlled so that a user can have an optimal directivity effect by setting an optimal digital filter coefficient value using measured signal delay values. In a conventional method, it is difficult to install a speaker and an amplifier together due to heat generated by the amplifier. However, in the present general inventive concept, since heat is effectively reduced using a digital amplifier of a PWM amplifying method, it is possible to install a speaker and an amplifier together.

The present general inventive concept can be realized as a method, an apparatus, and a system. When the present general inventive concept is manifested in computer software, components of the present general inventive concept may be replaced with code segments that are necessary to perform the required action. Programs or code segments may be stored in media readable by a processor, and transmitted as computer data that is combined with carrier waves via a transmission media or a communication network.

The media readable by a processor include anything that can store and transmit information, such as, electronic circuits, semiconductor memory devices, ROM, flash memory, EEPROM, floppy discs, optical discs, hard discs, optical fiber, radio frequency (RF) networks, etc. The computer data also includes any data that can be transmitted via an electric network channel, optical fiber, air, electromagnetic field, RF network, etc.

While this general inventive concept has been particularly shown and described with reference to preferred embodiments thereof, it will be understood by those skilled in the art that various changes in form and details may be made therein without departing from the spirit and scope of the general inventive concept as defined by the appended claims. The preferred embodiments should be considered in descriptive sense only and not for purposes of limitation. Therefore, the scope of the general inventive concept is defined not by the detailed description thereof but by the appended claims, and all differences within the scope will be construed as being included in the present general inventive concept.

What is claimed is:

1. A method of controlling directivity of a speaker system including a plurality of speaker arrays respectively corresponding to a plurality of channels, the method comprising:

sensing in each channel a shock sound having an impulse pattern generated at a listening position, and measuring delay values between signals of the channels and a delay between signals of the upper and the lower sides of a channel;

reading a predetermined listening position compensation filter coefficient in accordance with the measured delay values; and controlling directivity of the speaker unit by applying the read compensation filter coefficient to input audio signals.

2. The method of claim 1, wherein in the operation of sensing comprises:

sensing an impulse signal generated by a user via a plurality of microphones installed in the speaker system;

measuring signal delay values between channels whenever a magnitude of sound pressure of the impulse signal sensed in a channel exceeds a threshold value; and obtaining path differences between channels on the basis of the measured signal delay values.

3. The method of claim 1, wherein in the operation of sensing comprises:

reading stored listening position compensation filter coefficients corresponding to delay values corresponding to a delay value generated in accordance with a height difference between the upper and lower sides of a same channel and a delay value generated in accordance with a width difference between left and right channels.

4. The method of claim 1, wherein in the operation of controlling directivity of the speaker unit, the audio signals are signals convoluted with the listening position compensation filter coefficient.

5. A speaker system including a plurality of speaker arrays comprising:

a listening position sensing unit disposed adjacent to the plurality of speaker arrays sensing through a plurality of channels a shock sound with an impulse pattern generated at a listening position external to the plurality of speaker arrays;

a controller measuring delay values between signals of the channels and delay values between signals of the upper and lower sides of a channel using the shock sound sensed by the listening position sensing unit and reading a predetermined listening position compensation filter coefficient in accordance with the delay values and converting input audio signals into PWM audio signals by delay compensating the input audio signals using the compensation filter coefficient; and a power switching unit amplifying the PWM audio signals converted by the controller and outputting the amplified PWM audio signals via the plurality of speaker arrays.

6. The speaker system of claim 5, further comprising:

a plurality of microphones sensing a shock sound with an impulse pattern generated by a user; and an analog-to-digital (ADC) converter converting shock sounds sensed by the plurality of microphones into digital signals.

7. The speaker system of claim 6, wherein the plurality of microphones are installed in one or more speaker units including a plurality of series speakers and each of the one or more speaker units corresponds to a channel.

8. The speaker system of claim 5, further comprising:

a storage unit storing the listening position compensation filter coefficients corresponding to delay values as a look-up table.

9. A method of controlling directivity of a speaker system, the method comprising:

sensing shock sounds with an analog pattern generated external to a plurality of speaker arrays as an impulse of a plurality of channels and converting the analog pattern shock sounds into digital signals;

obtaining signal delay values between signals of the channels and signal delay values between signals of the upper and the lower sides of a channel using the sensed shock sounds;

reading a listening position compensation filter coefficient on the basis of the obtained signal delay values; and controlling directivity of the speaker unit by applying the read compensation filter coefficient to input audio signals.

10. The speaker system of claim 5, the controller further comprising:

a digital signal processing unit; and a read-only-memory (ROM) to store optimal listening position compensation filter coefficients corresponding to a plurality of delay values as a look-up table.

11. The speaker system of claim 5, wherein the sensing of the listening position sensing unit further comprises:

sensing an impulse signal generated by a user via a plurality of microphones installed in the speaker system;

measuring signal delay values between channels whenever a magnitude of sound pressure of the impulse signal sensed in a channel exceeds a threshold value; and obtaining path differences between channels on the basis of the measured signal delay values.

12. The speaker system of claim 5, wherein the sensing of the listening position sensing unit further comprises:

reading stored listening position compensation filter coefficients corresponding to delay values corresponding to a delay value generated in accordance with a height difference between the upper and lower sides of a same channel and a delay value generated in accordance with a width difference between left and right channels.

13. The speaker system of claim 5, wherein the operation of delay compensating of the controller further comprises:

compensating for the listening position using the listening position compensation filter coefficients that correspond to the sound delay information.

* * * * *